United States Patent [19]

Lewis

[11] Patent Number: 5,029,621

[45] Date of Patent: Jul. 9, 1991

[54] PUSH BACK PROCEDURE FOR PREVENTING DROP-FORMER DROPLET FORMATION IN A VACUUM ASSISTED SOLUTION TRANSFER SYSTEM WITH UPSTREAM OCCULUSION

[75] Inventor: Robert Lewis, Lindenhurst, Ill.

[73] Assignee: Clintec Nutrition Co., Deerfield, Ill.

[21] Appl. No.: 507,757

[22] Filed: Apr. 12, 1990

[51] Int. Cl.[5] ..... B65B 3/28

[52] U.S. Cl. ..... 141/1; 141/86; 141/115; 141/116; 141/311 A; 141/59; 222/108; 239/119

[58] Field of Search ..... 141/115, 116, 119, 126, 141/127, 1, 59, 83, 311 A, 86, 117; 222/571, 108; 239/119

[56] References Cited

U.S. PATENT DOCUMENTS

| | | | |
|---|---|---|---|
| 2,650,003 | 8/1953 | Coleman | 141/119 X |
| 2,978,149 | 4/1961 | Rosen | 141/116 X |
| 3,511,468 | 5/1970 | Young | 141/116 X |
| 4,149,574 | 4/1979 | Lehmann et al. | 141/83 X |
| 4,178,974 | 12/1979 | Levin | 141/51 |
| 4,230,160 | 10/1980 | Buckley | 141/116 |
| 4,254,806 | 3/1981 | Elsworth | 141/116 |
| 4,789,014 | 12/1988 | DiGianfilippo et al. | 141/83 |

*Primary Examiner*—Ernest G. Cusick

*Attorney, Agent, or Firm*—Hill, Van Santen, Steadman & Simpson

[57] ABSTRACT

A device for vacuum-assisted transfer of fluid from one container to another via a conduit and having an occluder positioned between the containers includes apparatus and method for clearing fluid from the conduit downstream of the occluder by forcing the fluid upstream of the occluder.

23 Claims, 9 Drawing Sheets

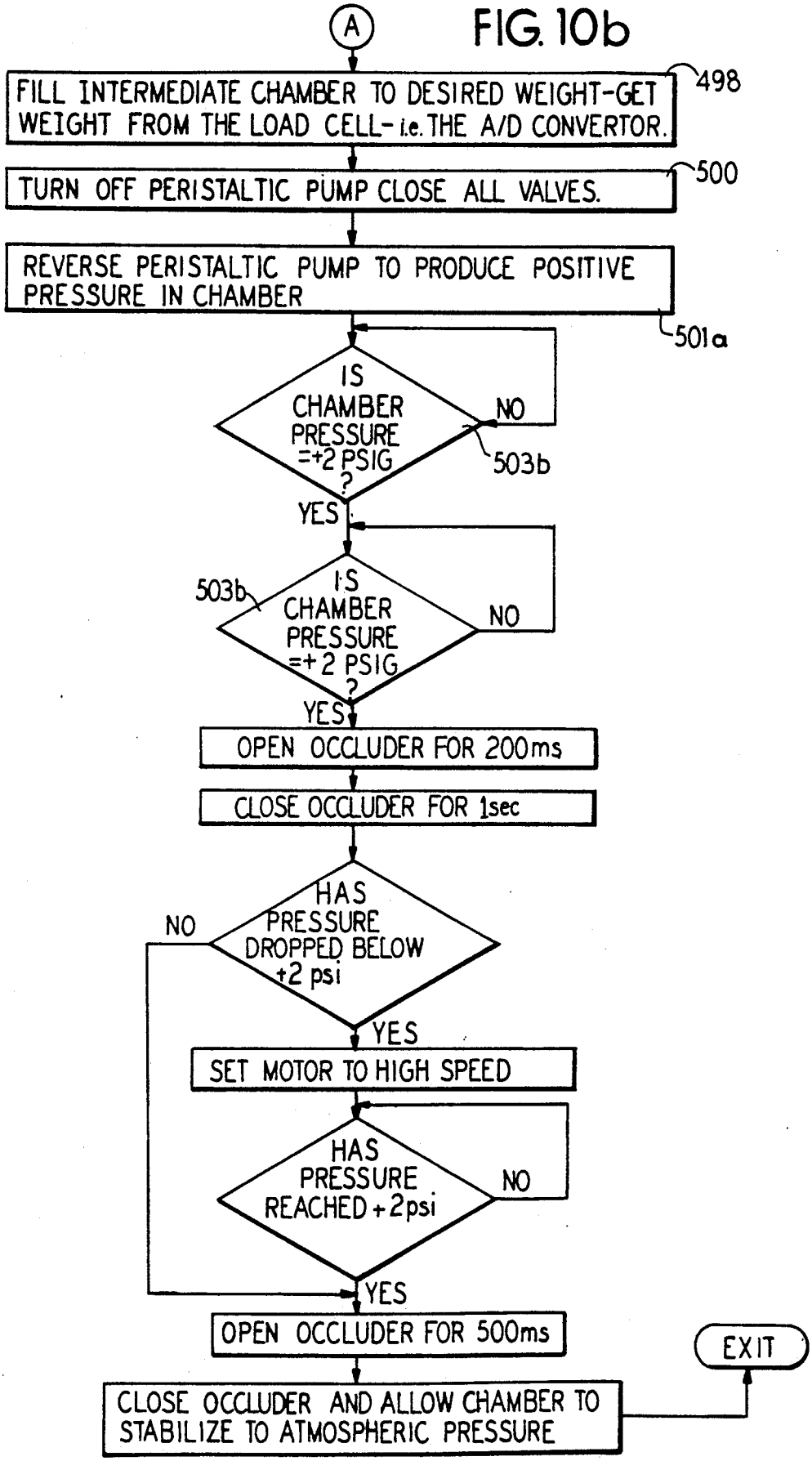
A
FIG. 10b
FILL INTERMEDIATE CHAMBER TO DESIRED WEIGHT-GET WEIGHT FROM THE LOAD CELL- i.e. THE A/D CONVERTOR.
498
TURN OFF PERISTALTIC PUMP CLOSE ALL VALVES.
500
REVERSE PERISTALTIC PUMP TO PRODUCE POSITIVE PRESSURE IN CHAMBER
501a
IS CHAMBER PRESSURE =+2 PSIG ?
NO
503b
YES
503b
IS CHAMBER PRESSURE =+2 PSIG ?
NO
YES
OPEN OCCLUDER FOR 200ms
CLOSE OCCLUDER FOR 1sec
HAS PRESSURE DROPPED BELOW +2 psi
NO
YES
SET MOTOR TO HIGH SPEED
HAS PRESSURE REACHED +2psi
NO
YES
OPEN OCCLUDER FOR 500ms
CLOSE OCCLUDER AND ALLOW CHAMBER TO STABILIZE TO ATMOSPHERIC PRESSURE
EXIT

PUSH BACK PROCEDURE FOR PREVENTING DROP-FORMER DROPLET FORMATION IN A VACUUM ASSISTED SOLUTION TRANSFER SYSTEM WITH UPSTREAM OCCULUSION

BACKGROUND OF THE INVENTION

The present invention relates to apparatus for selectively transmitting fluids. More particularly, the invention relates to methods and apparatus for transferring minute quantities of a plurality of fluids to a single mixing chamber. Yet more particularly, the invention is directed to methods and apparatus for preventing inadvertent transfer of a fluid wherein a line for transmitting the fluid is occluded.

A variety of devices and/or applications are designed such that one or more fluids are selectively conducted from individual sources to one or more common receptacles. One example of a device including such a feature is disclosed in U.S. Pat. No. 4,789,014, the teachings of which are fully incorporated herein.

In the device disclosed in U.S. Pat. No. 4,789,014, fluids such as drugs, are conducted from source vials to a common mixing and weighing chamber. The mixed fluids are then conducted to a single receptacle such as a bag of an administration set.

It is disclosed that the fluids added to the mixing chamber can be of very minute quantities—on the order of a few drops. As such, it is apparent that even minute quantities of the fluids can be significant. Accordingly, it is important to ensure that even minute quantities of fluids are not added to the mixing chamber.

As is further disclosed in U.S. Pat. No. 4,784,014, commencing at column 7, line 55, each tube that couples a respective vial to the mixing chamber is connected to a manifold in the upper portion of the chamber. The manifold includes a series of connector conduits to which one end of each of the individual tubes can be attached to provide fluid communication between the individual fluid tubes and the chamber when the manifold is connected to the chamber. The manifold includes individual spaced-apart, drop-former structures for each line for discouraging accumulation of droplets on the manifold. This prevents possible mixing of incompatible solutions due to droplets hanging on the manifold.

Positioned upstream of the manifold is a unit containing individual occlusion devices, one occlusion device for each tube coupled to a source fluid vial. The occlusion devices are employed to selectively occlude their respective tubes to allow fluid to flow from their respective source vial to the chamber.

To assist in the transfer of a fluid from a source vial, it is disclosed that the mixing and weighing chamber is placed under a vacuum pressure to thereby create vacuum assisted transfer. One problem that can arise in such a situation, however, is that such a vacuum in the chamber will also exert a vacuum pressure on all of the drop former outlets. Should an occluded tube contain a bubble/small volume of air between the occlusion device and the chamber, it is possible for the vacuum pressure to create an expansion of that bubble in the tube downstream of the occlusion device. Essentially, expansion of the air can cause displacement of fluid downstream of the bubble, this possibly causing fluid to drop from the drop former into the measuring chamber despite the fact that the particular tube is in an occluded state. Accordingly, fluid can be transferred although its particular tube might be perceived to be occluded.

As a result of the foregoing, it is possible that erroneous measurements of transferred fluids can be made. Further, it is possible that undesirable dosages of fluids can be added to a mixture.

SUMMARY OF THE INVENTION

The present invention provides a procedure for preventing undesired fluid transfer in a vacuum assisted solution transfer system with upstream occlusion.

To this end, the invention provides in an embodiment, a procedure whereby a receiving chamber, which normally is placed under a vacuum pressure during a fluid transfer, is imparted with a positive pressure while an upstream occluder is pulsed sufficiently open to allow any fluid in a transfer line associated therewith to be displace upstream of the occluder.

The present invention in an embodiment provides a device for vacuum-assisted transfer of fluid from one container to another via a conduit.

In an embodiment, the invention provides that the occluder is pulsed open twice.

In an embodiment, the occluder is pulsed open twice for a duration of 200 ms each pulse.

In an embodiment, the occluder is pulsed open twice, the first time for a duration of 200 ms, the second time for a duration of 500 ms.

In an embodiment, the receiving chamber is pressurized to a pressure of +2 PSIG.

These and other features of the invention will become more apparent with reference to the following detailed description of the presently preferred embodiment and the accompanying drawings.

BRIEF DESCRIPTION OF THE DRAWINGS

FIG. 3(*b*) illustrates in cross-sectional view the coupler of FIG. 3(*a*).

FIG. 4(*b*) illustrates in cross-sectional view the manifold of FIG. 4(*a*).

FIG. 5(*b*) illustrates in cross-sectional view the chamber of FIG. 5(*a*).

FIG. 5(*c*) illustrates in perspective view a cap used in connection with the chamber of FIG. 5(*a*).

FIGS. 10*a* and 10*b* comprise a flow chart illustrating a fill routine executed by the control system to effect transfer of a fluid from a source vial to the chamber.

DETAILED DESCRIPTION OF THE PRESENTLY PREFERRED EMBODIMENTS

Figure 1:
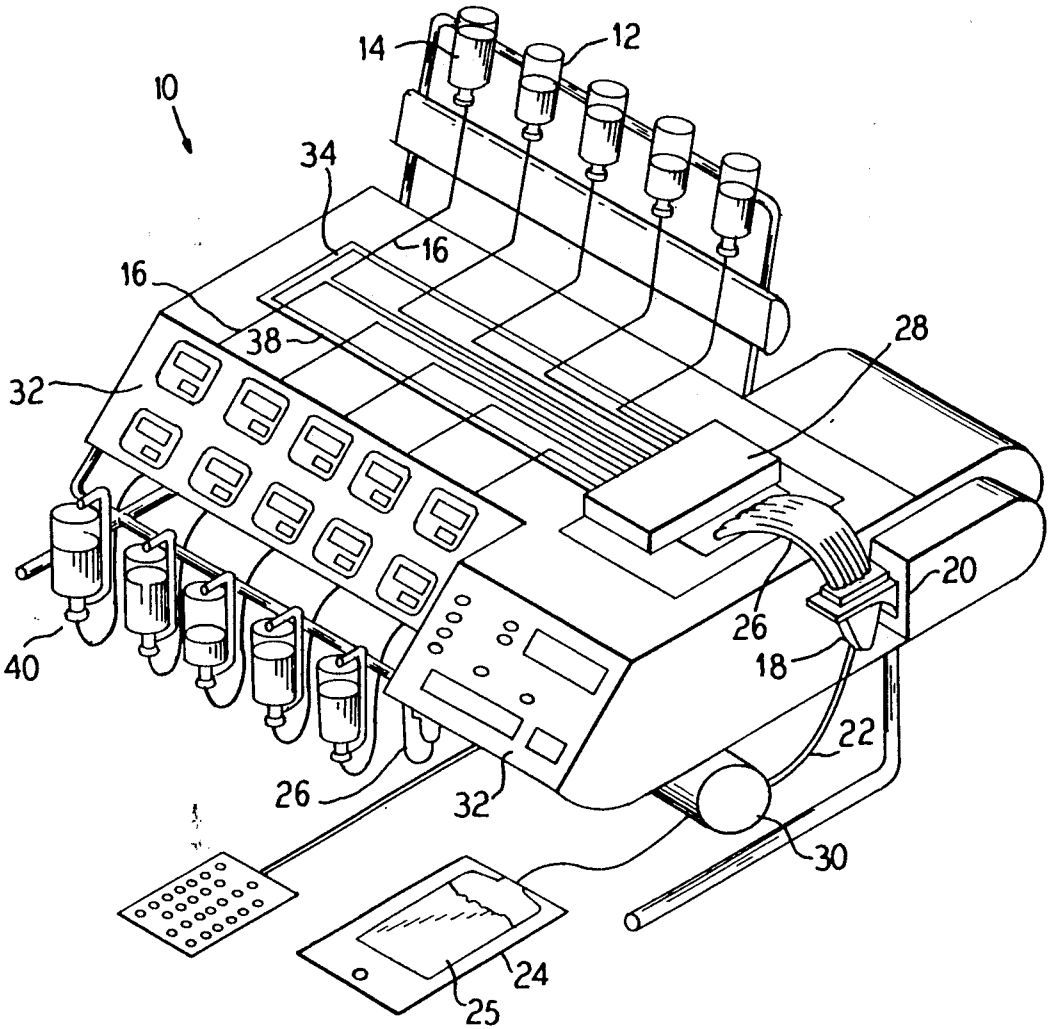
FIG. 1 illustrates in perspective view a device for the vacuum assisted transfer of a plurality of source fluids to a single receptacle.

In accordance with U.S. Pat. No. 4,789,014, the teachings of which are fully incorporated herein by reference, a device 10, illustrated in FIG. 1, is provided for accurately transferring individual doses of separate fluids from individual source containers 12. Each individual source container can contain a different fluid 14. In some cases, the fluid in one container may be incompatible with fluids contained in other source containers. According to the invention, fluid is transferred from each source container 12 through a separate individual fluid conduit 16 to a single chamber 18. The chamber 18 is suspended from a load cell assembly 20. The load cell 20 constantly weighs the total weight of the chamber to develop an output signal which is indicative of the amount of fluid in the chamber 18 at any given time.

The chamber 18 is provided with a single chamber fluid outlet conduit 22 which is in fluid communication with a single receiving container 24. In accordance with a preferred embodiment of the invention, the receiving container 24 might be previously partially filled with a base solution 25 that can consist of amino acids, dextrose, and fat emulsions. However, it is not required that the receiving container contain any fluid prior to operation of the device 10.

The chamber 18 also includes a pressure conduit 26 which is in contact with a pressure means. In a preferred embodiment of the invention, the pressure means is a single peristaltic pump. The purpose of the pressure means is to selectively create positive and negative pressures in the chamber 18 during operation of the device to control the rate of fluid flow into and out of the chamber 18.

The device is further provided with a first occlusion means 28 which will be discussed in greater detail below. The purpose of the first occlusion means is to selectively prevent fluid flow from each of the individual fluid conduits 16 from entering the chamber 18 in the absence of a command from a control means 32. During operation of the device 10 in a preferred mode of the invention, the first occlusion means 28 allows fluid to flow from only one source container 12 at a time to the changer 18. In this manner, it is possible to very accurately monitor the amount of fluid flowing from each container into the chamber through the use of the load cell assembly 20.

The device further includes a second occlusion means 30 for selectively occluding fluid flow from the chamber outlet fluid conduit 22 to the receiving container 24. In a preferred embodiment of the invention, the second occlusion means 30 is a solenoid occluder.

The device 10 is controlled by a control means 32 which controls the first and second occlusion means as well as the pressure means. The control means causes the first occlusion means to allow fluid flow through at least one of the individual fluid conduits 16 while causing the second occlusion means 30 to prevent fluid flow from the chamber 18 into the receiving container. The control means 32 enhances fluid flow into the chamber 18 by creating a negative pressure in the chamber, thereby drawing fluid from the source container 12 through the individual conduit line 16 into the chamber. After the load cell 20 senses that the appropriate amount of fluid has entered the chamber 18 from a particular source container 12, the control means causes the first occlusion means 28 to prevent further fluid flow from that source container. At this point, the control means 32 can then either cause the first occlusion means 28 to allow fluid to flow from another source container into the chamber, or cause the second occlusion means 30 to open to allow fluid to flow from the chamber 18 into the receiving container 24.

The control means can allow a second fluid to flow into the chamber when a first fluid is still present in the chamber if the first and second fluids are compatible with each other and there is sufficient empty space remaining in the chamber to receive the entire amount of the second fluid to be dispensed. The control means will not allow a second fluid to enter the chamber when a first fluid is still present if the two fluids are incompatible with each other when properly programmed, or if insufficient room exists in the chamber.

The control means 32 enhances fluid flow from the chamber 18 into the receiving container 24 by causing the pressure means to generate a positive pressure in pressure conduit 26 which is in fluid communication with the chamber 18. This causes a positive pressure in the chamber so that when the second occlusion means 30 is opened to allow fluid to flow from the chamber to the receiving container 24, the positive pressure will force the fluid out of the chamber and into the receiving container 24. This greatly reduces fluid retention in the chamber 18.

Figure 2:
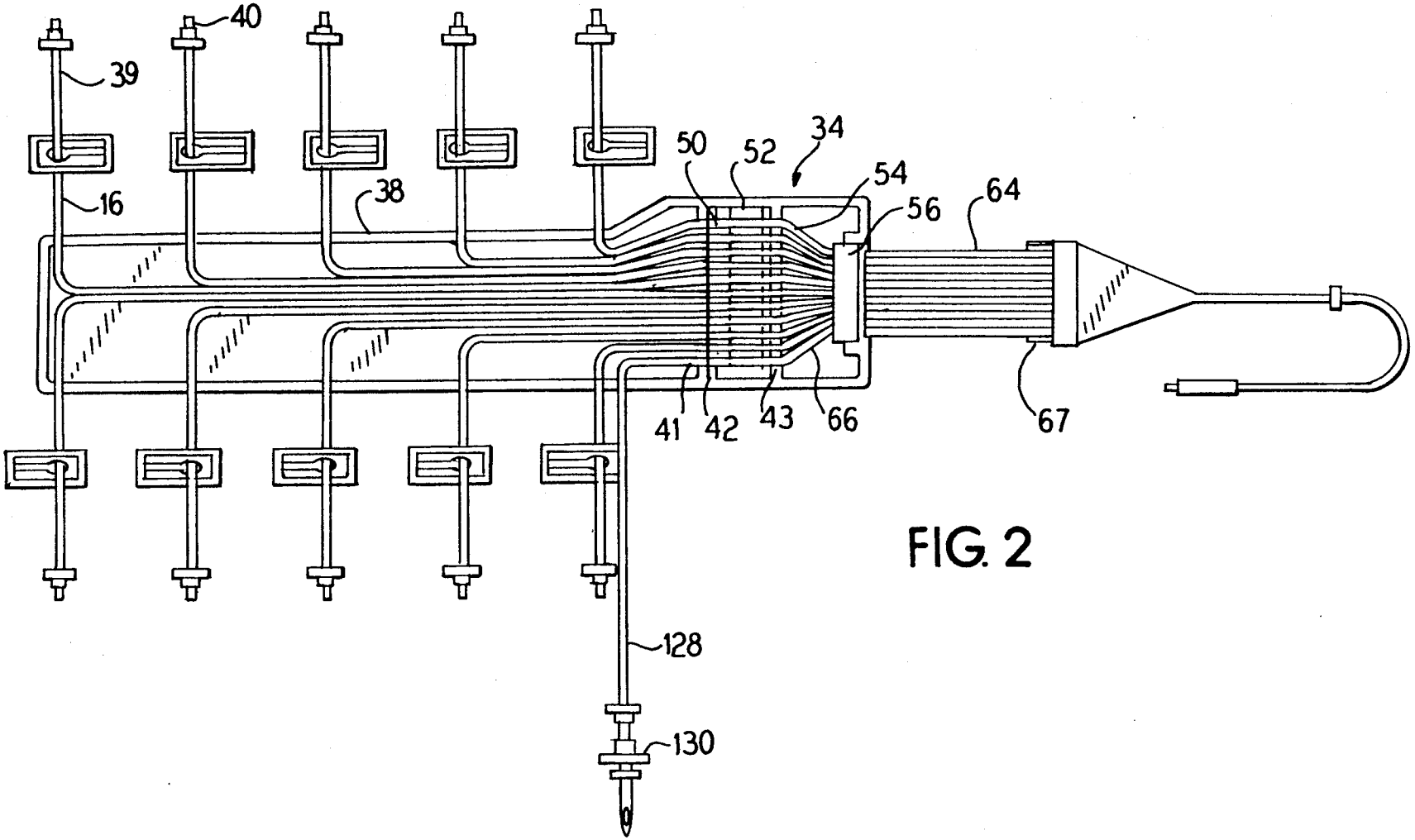
FIG. 2 illustrates in plan view a transfer set employed in the device of FIG. 1 for coupling the various fluid sources to the common receptacle.

The purpose of the transfer set 34 is to transfer fluids from each of the individual containers 12 into the receiving container 24. As illustrated in FIG. 2, the transfer set 34 includes a plurality of individual fluid conduits 16. Each of the individual fluid conduits 16 is formed of a flexible piece of tubing. Various materials can be used to make the flexible conduits such as polyvinylchloride (PVC) or polyethylene tubing. Polyethylene tubing is desired when the device is used with drugs that are incompatible with PVC.

Each of the individual conduits 16 includes a proximal end that is mounted in a tray 38. The purpose of the tray 38 is to maintain each conduit 16 in a spaced-apart relationship from the other conduits and to keep the tubes organized when the transfer set is being mounted onto the device 10. In a preferred embodiment, the tray 38 is a vacuum-formed plastic tray made of PVC or glycol-modified polyethylene teraphthalate (PETG).

In a preferred embodiment of the invention, the tray is specifically designed so that the distal end 39 of each fluid conduit 16 is positioned adjacent to the particular source container 12 to which the distal end 39 of the conduit 16 is to be connected.

Referring again to FIG. 1, the individual conduit 16 exits tray 38 in such a manner that half of the individual conduits 16 are directed to one side of the device 10, while the other half of the individual conduits are directed downwardly to the other side of the device. Since the source containers in the preferred embodiment are disposed along both sides of the device 10, this greatly assists the pharmacist in insuring that the appropriate individual conduit 16 is connected to its respective container 12 when the transfer set is placed in the device 10.

In one embodiment of the invention, each of the individual conduits may be color-coded with a stripe or other type of coding on the tubing to indicate the identity of a particular tube. In a preferred embodiment, each conduit 16 contains a vented spike 40 at the distal end. This spike 40 is used to provide fluid communication between the distal end of the conduit 16 and an individual container 12.

The purpose of providing a vented spike 40 is to allow air to vent into the source container 12 as the fluid is being dispensed from the source container when the source container is a rigid, non-vented vial. It is currently envisioned that the source containers will be formed of either glass or plastic vials, bottles, or bags. However if flexible containers are used as the source containers, or if the source containers are vented, it is not necessary to provide venting in the spike.

Referring once again to FIG. 2, the tray 38 contains a coupler 42. The proximal end 41 of each fluid conduit 16 is attached to one side of the coupler. Individual tubes 43 which are highly compliant are attached to the other side of the coupler 42.

Figure 3A:
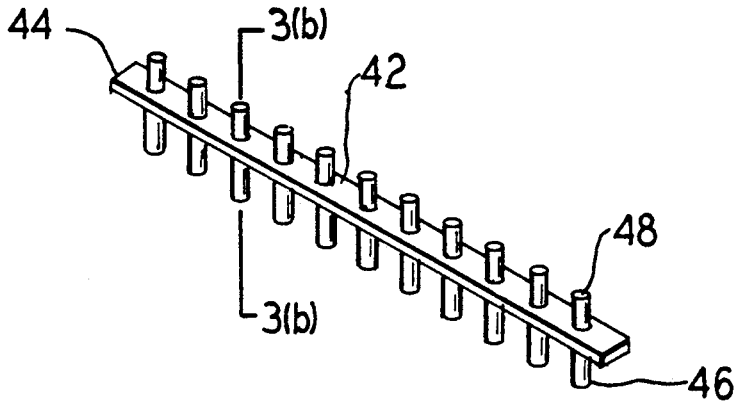
FIG. 3(*a*) illustrates in perspective view a coupler used in connection with the transfer set of FIG. 2.
Figure 3B:
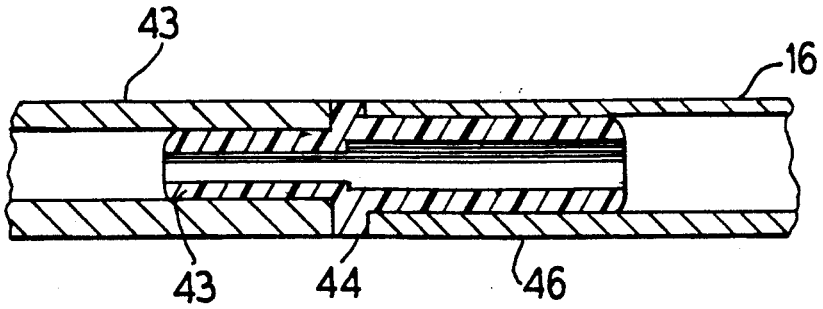

Referring now to FIGS. 3(*a*) and (*b*), the coupler 42 is illustrated in greater detail. As illustrated, the coupler 42 includes a wall 44 that contains a first series of coupling conduits 46 extending from one side thereof and a second series of coupling conduits 48 extending from the other side of the wall 44. Each of the first and second coupling conduits in the series is in fluid communication with one another. Accordingly, when the distal end of each one of the conduits 16 is fixed in fluid communication with one of the first series of conduits 46, and a proximal end of one of the highly compliant individual tubes 43 is attached to one of the second series of conduits 48, fluid communication is established between conduit 16 and its respective highly compliant individual tube 43. While other methods of producing fluid communication between conduits 16 and individual tubes 43 may be used in accordance with the invention, the coupler illustrated in FIGS. 3(*a*) and (*b*) represent one system for attaching the two portions of tubing to one another while maintaining the tubes in a highly organized manner.

Referring once again to FIG. 2, as illustrated in the figure, the tray 38 includes a first series of finger-like projections 50 which maintain the compliant tubes in a spaced-apart relationship from one another immediately adjacent the coupler 42. The compliant tubes 43 are then positioned in the tray such that they pass between an open section or window 52 in the tray. When the tray is mounted in the device 10, the open section is in direct contact with the first occluder means 28 to provide appropriate occlusion of the compliant tubes 43, as will be discussed in greater detail below.

As illustrated in FIG. 2, the individual tubes 43 then pass through a second series of finger-like projections 54 downstream from the window. The second series of finger-like projections 54 also maintains the tubing in the appropriate position to ensure that occlusion of the appropriate tube occurs. Of course, it is possible to provide a variety of systems for maintaining the tubing in the appropriate position.

As also illustrated in FIG. 2, one end of the individual tubes 43 is connected to a manifold 67 in the upper portion of chamber 18. The manifold is illustrated in more detail in FIGS. 4(*a*) and (*b*).

Figure 4:
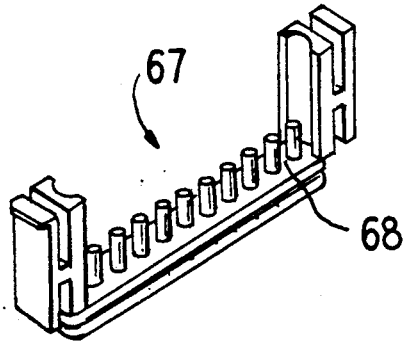
FIG. 4(*a*) illustrates in perspective view a manifold used in connection with the transfer set of FIG. 2.
Figure 4:
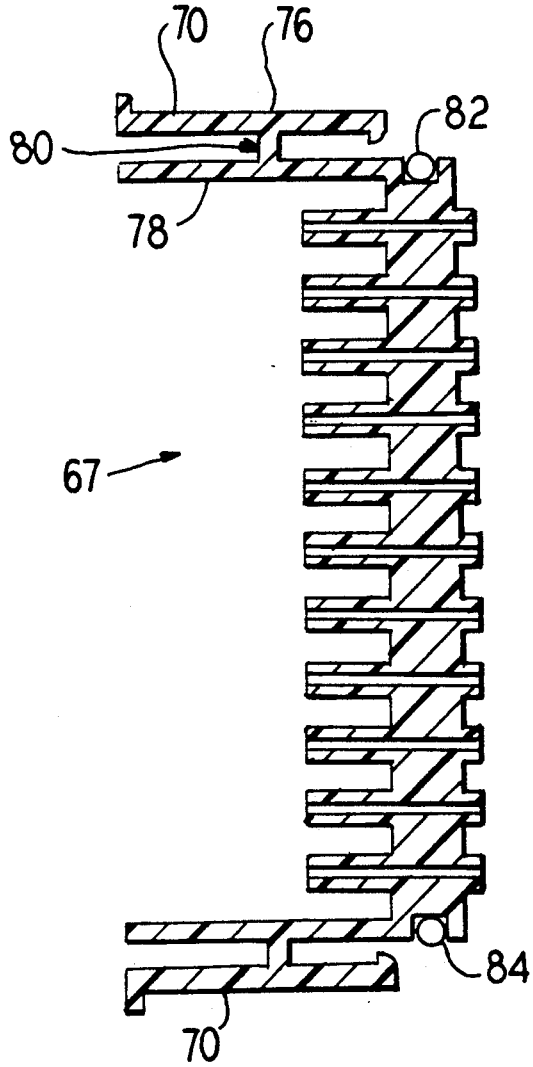

As illustrated in FIG. 4(*a*), the manifold includes a series of connector conduits 68 to which one end of each of the individual tubes 43 can be attached to provide fluid communication between the individual fluid tubes and the chamber when the manifold is connected to the chamber. The manifold has individual, spaced-apart, drop-former structures for each line for discouraging accumulation of droplets on the manifold. This prevents possible mixing of incompatible solutions due to droplets hanging on the manifold.

In a preferred embodiment, the manifold 67 can be disconnected from the chamber. This feature of the invention allows a user of the device 10 to change chambers 18 after each use without changing the transfer set. While it is not currently envisioned that it will be necessary to change a chamber 18 after preparing a solution for each individual patient, it may occasionally be desirable to use a new chamber whenever a highly incompatible drug or a highly toxic drug has been dispensed using the device.

Figure 5A:
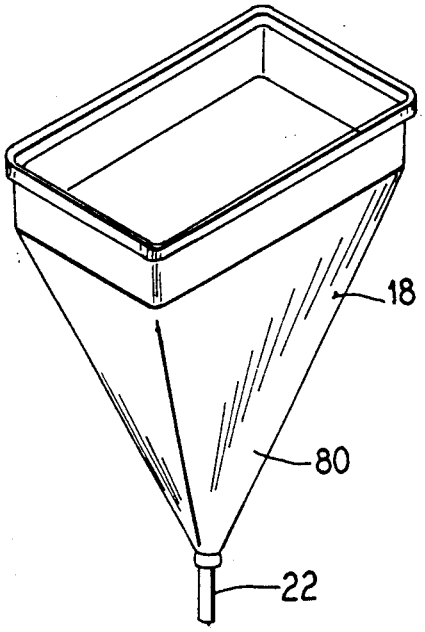
FIG. 5(*a*) illustrates in perspective view a receiving chamber used in connection with the transfer set of FIG. 2.
Figure 5B:
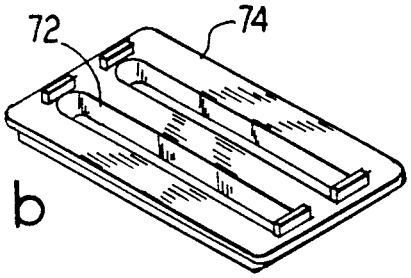
Figure 5C:
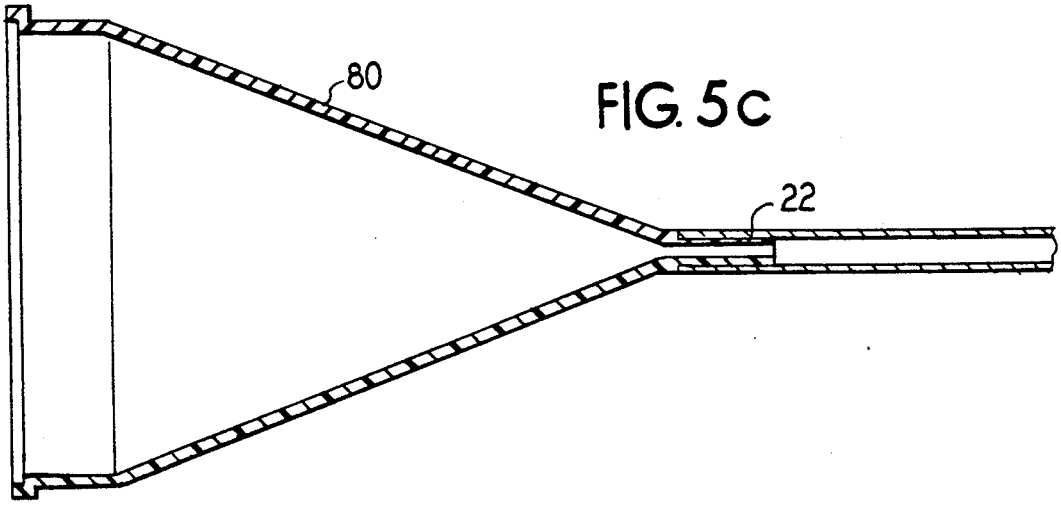

Referring now to FIG. 4(*b*), as illustrated, a pair of latches 70 provide a mechanism by which the manifold is releasably engaged with the chamber. Each latch can be flexed to release the manifold 67 from a locking groove 72 in the top or cap 74 of the chamber 18, as illustrated in FIG. 5(*c*). In a preferred embodiment of the invention, the latch consists of an arm 76 which is mounted on a frame 78 of the manifold. A flexible connecting portion 80 maintains the arm 76 in a parallel relationship to a portion of the frame 78 of the manifold. The latch 70 can be flexed so that the arm 76 and the frame 78 are no longer parallel with one another to release the manifold from the cap 74 of the chamber.

In order to provide a temporary seal between the manifold and the chamber cap 74, in an embodiment of the invention, an O-ring 82 is provided around a groove 84 in the manifold. Typically, the O-ring is formed of silicone rubber or neoprine, however, other materials can be used. The O-ring provides an air-tight seal between the manifold and the cap during engagement of the manifold 67 to the cap of the chamber.

The chamber of a preferred embodiment of the invention is more clearly illustrated in FIGS. 5(*a*), (*b*) and (*c*). As illustrated in FIG. 5(*a*), the chamber 18 has a generally rectangular cross-sectional area in the embodiment. One reason for providing a rectangular cross-sectional area is to allow the body of the chamber to be placed as close as possible to the device 10 when the transfer set 34 is loaded in the device.

The chamber is also designed to have downwardly sloping walls 80 from the top of the chamber to the outlet conduit 22. This helps absorb impact on the load cell of fluids, as they are released from the manifold 67, that results from the acceleration of the fluids due to gravity. The effective height for acceleration is reduced by the funnel shape defined by the downwardly sloping walls 80. This also reduces splashing which means less need for rinsing of the chamber. As will be readily apparent to one skilled in the art, it is possible to design chambers having other shapes.

One feature of the chamber 18 is that a pressure line 26 (FIG. 1) is in communication with an upper portion of the chamber and that the manifold 67 delivers individual fluids from each of the individual fluid lines into the chamber through a separate fluid path. This means that any mixing of the fluids does not occur until the fluid enters the chamber. As discussed above, it is possible to prevent mixing of fluids in the chamber if desired by emptying the chamber after each individual fluid has entered the chamber.

Figure 6:
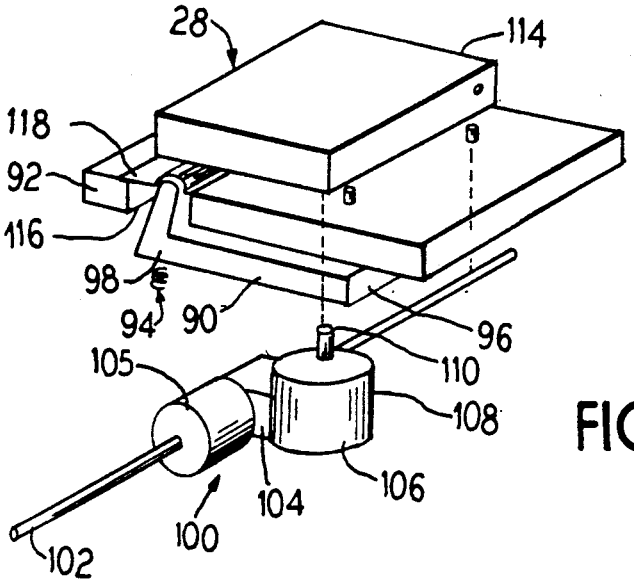
FIG. 6 is a perspective view of an occlusion means of the device of FIG. 1.
Figure 7:
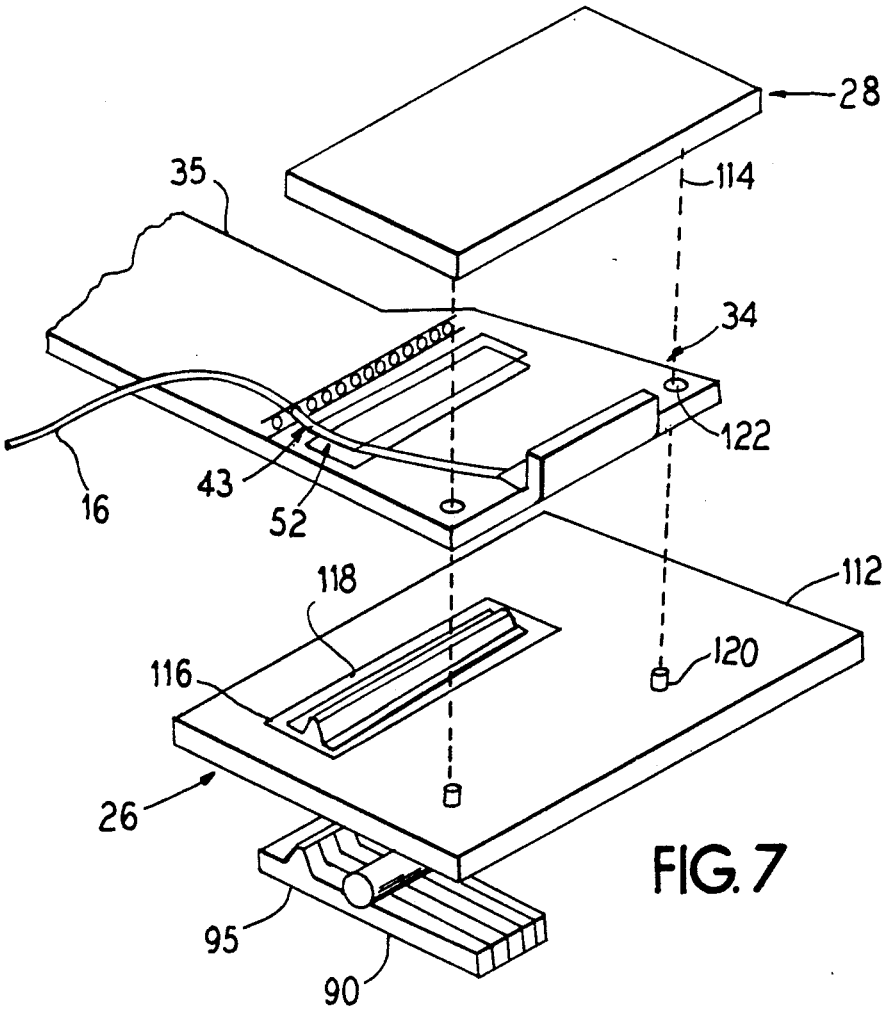
FIG. 7 is an exploded perspective view of the occlusion means of FIG. 6.

Referring now to FIGS. 6 and 7, when the transfer set 34 is positioned in the device, the tray 38 is positioned so that the window 52 is positioned adjacent to the first occlusion means 28. Each of the compliant individual tubes 43 adjacent to the window 52 is positioned adjacent to multiple individual occluding arms 90 in the first occlusion means.

As illustrated in FIGS. 6 and 7, the occlusion means includes a frame 112 for receiving a portion of each of the compliant individual tube (not shown). As discussed above, the compliant individual tubes are positioned in a spaced-apart parallel relationship with one another in the frame 112. Multiple occluder arms 90 are pivotably mounted in the frame 112. Each arm 90 is pivotable from a first to a second position, in which first position, fluid flow through its respective compliant individual tube 43 is totally occluded. When the arm 90 is in the second position, fluid flow through its respective conduit is allowed.

The first occluder means 28 is provided with multiple individual biasing means for biasing each one of the arms in the first position. In a preferred embodiment of the invention, the individual biasing means consists of a spring 94 positioned at a first end 98 of each of the arms 90 to cause the same end 98 of each of the arms to be forced toward the compliant individual tubes 43 to cause occlusion of the conduits. More specifically, each spring 94 is positioned between the first end of the arm 98 and a portion of the frame 112 to cause occlusion of the individual conduits.

The first occluding means 28 is also provided with a first drive means 100 for overcoming the individual biasing means 94 to force at least one of the arms 90 into the second position in response to a command from the control means 32. In a preferred embodiment of the invention, the first drive means includes a drive screw 102 mounted in the frame in a traverse position with respect to the individual tube 43. A carriage 104 is provided on the drive screw.

In a preferred embodiment of the invention, a motor 105 is provided on the carriage 104 to move the carriage 104 along the drive screw in response to a command from the control means 32. The carriage is moveable along the drive screw so that the carriage can be positioned immediately below each of the individual occluder arms 90. A bias overcoming means 106 is mounted on the carriage 104 between the carriage and the individual occluder arms for overcoming only one of the individual bias means, or springs, 90 when the bias overcoming means 106 is immediately below one of the individual occluder arms 90.

In a preferred embodiment of the invention, the bias overcoming means 106 is a single solenoid 108 which includes a rod 110 moveable from a withdrawn position to an extended position. In the withdrawn position, the rod does not contact an adjacent occluder arm 90. In the extended position, the rod forces an adjacent occluder arm 90 from the first to the second position to cause the first end 98 of the occluder arm 90 to retract from its associated individual tube 43. This allows fluid to flow through the individual conduit.

In a preferred embodiment of the invention, the rod 110 has a width that is less than the distance between the spaced apart portions of the individual occluding arms so that only one of the occluding arms may be contacted at a time. This provides a fail-safe means for insuring that fluid is allowed to flow through only one individual fluid conduit at a time.

The first occlusion means 28 (FIG. 7) includes a frame 112 and a hinged door 114. The hinged door can be open to receive the window portion 52 of the transverse set 34. The frame 112 includes an aperture 116 to receive a portion of the first end 98 of each of the individual occluding arms 90. The aperture is covered with a resilient material 118 in a preferred embodiment of the invention to limit the possibility of fluid leakage into the drive means 100 of the first occluder means 28. This resilient material 118 may be formed of silicone in a preferred embodiment.

In one embodiment of the invention, the first occlusion means 28 may include a sensing means for detecting the position of each of the compliant individual tubes 43 in the frame and for determining whether the individual tubes are occluded by the arms. This sensing means can include a series of spring-loaded switches in the door 114 of the frame. Typically, these switches can be two-position switches that detect the presence of an occlusion force on each of the individual tubes when the door, 114 is closed over the tubes. If a tube is not in its appropriate position, or if an occlusion arm is not properly biased to occlude its respective tube, a relatively low force would be detected by the two-position sensors indicating a possible malfunction of the device.

In one embodiment of the invention, the tray 38 of the transfer set and the frame 112 of the first occluder are provided with a mating means to ensure proper placement of the tray in the frame of the first occluder. In a preferred embodiment of the invention, as illustrated in FIG. 7, the mating means consists of a pair of outwardly extending pegs 120 in the frame 112, and a corresponding pair of apertures 122 in the tray of the transfer set. Thus, when an operator places the tray of the transfer set into the frame of the occluder, the apertures 122 must be positioned over the pegs 120 in order for the door 114 of the frame to close. This is one mechanism by which the position of the compliant individual tubes 43 is checked for proper location.

Figure 8:
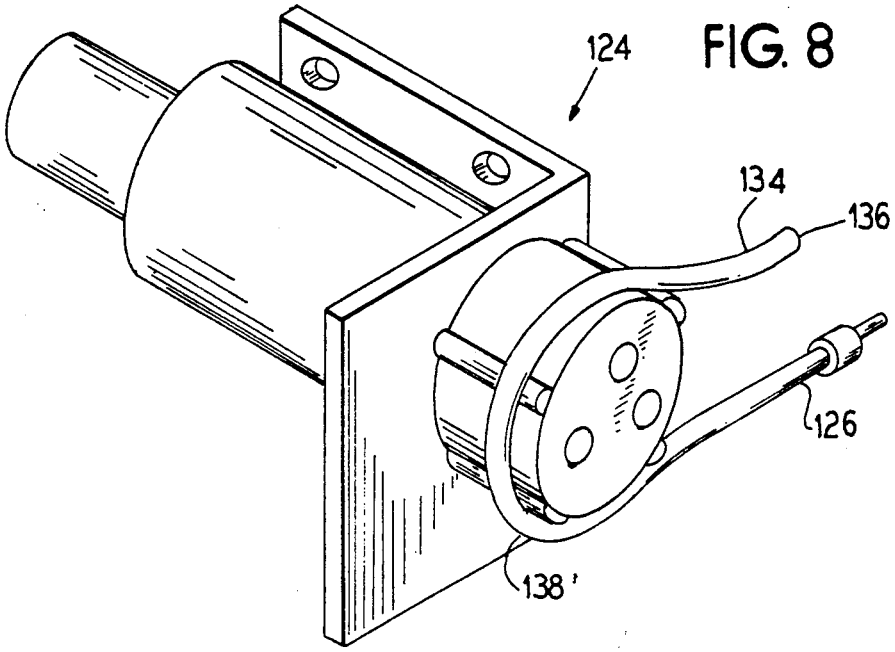
FIG. 8 is a perspective view of pressure means for selectively creating positive and negative pressures in the chamber of FIGS. 5(*a*)-(*c*).

As discussed above, a pressure means 124 (FIG. 8) is provided for selectively creating positive and negative pressures in the chamber 18 to control the rate of fluid flow through the chamber. The pressure means is in fluid communication with the pressure conduit 26 through the use of a luer fitting 132.

In a preferred embodiment of the invention, the pressure conduit 26 is simply a conduit line 128 of the transfer set 34 as illustrated in FIG. 2. This conduit line 128, unlike the other individual conduit lines 16, is not connected to an individual source container. Instead, the conduit line 128 is provided with a filter means 130 for filtering air entering the conduit line 128 and is connected to a peristaltic pump. The peristaltic pump can rotate in either direction to either pull air from the environment into the first end of the flexible tubing, or to force air that is in the tubing out of the tubing.

Figure 9:
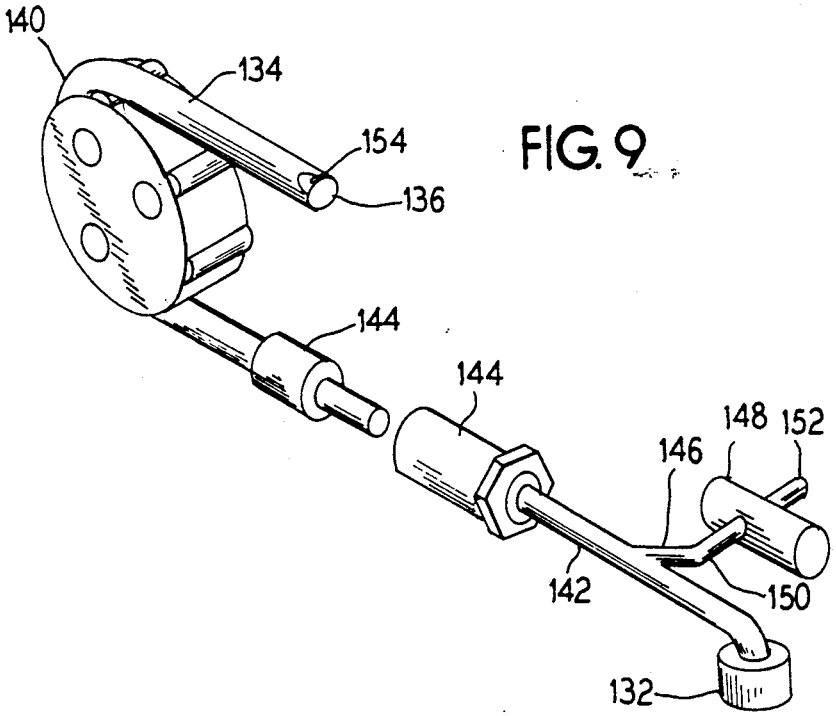
FIG. 9 illustrates in perspective view tubing used in the pressure means of FIG. 7 in conjunction with a peristaltic pump head and an air venting means used in one embodiment of the invention.

In a preferred embodiment of the invention illustrated in FIG. 9, the tubing 134 can consist of a first portion 140 and a second portion 142. The first and second portions can be connected to each other with a quick-disconnect coupler 144.

In a preferred embodiment of the invention, the first portion of tubing is a highly compliant tube formed of silicone or other material to increase the accuracy of the pump in terms controlling precise amounts of air flow through the tubing with a minimum amount of force from the peristaltic pump. The first and second portions of the tubing are connected to each other with a quick-disconnect device to allow the first portion to be replaced if it becomes worn from usage.

In one embodiment of the invention, the second portion of tubing 142 may include a Y-site 146 or other junction. One leg of the junction 146 may be connected to an air vent means 148 to provide a rapid return of air pressure in the line 142 to atmospheric pressure. This is very useful, for example, when it is desired to change the pressure in the chamber 18 from a negative to a positive pressure to empty fluid in the chamber into the receiving container 24.

In a preferred embodiment of the invention, the air vent means 148 consists of a conduit 150 having one end open to the environment. A solenoid valve 152 is attached to the end open to the environment to selectively open and close conduit 150 in response to signals from the control means as will be discussed more fully below.

In a preferred embodiment of the invention, the flexible tubing 134 is connected to the pressure conduit 26 with a luer connection device 132. Of course, other methods of connecting the flexible tubing 134 to the pressure conduit can be used.

The precise procedure by which fluid is actually pumped from the source containers into the chamber 18 by the control means will now be discussed with respect to FIG. 10. The control means and other related procedures can be those disclosed in U.S. Pat. No. 4,789,014.

Figure 10A:
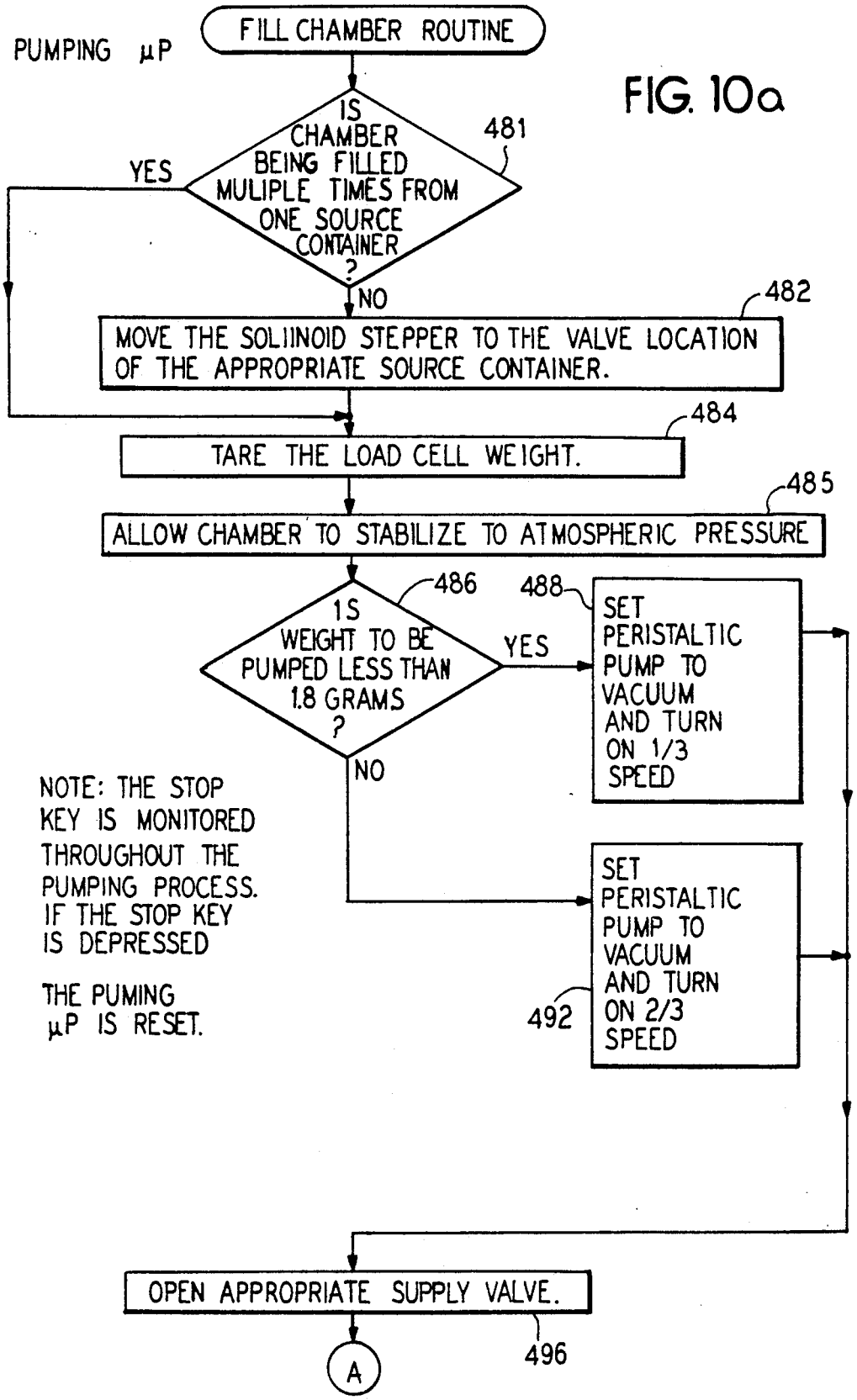

In FIGS. 10*a* and *b*, there is illustrated a "fill routine" whereby the procedure effectuated by the device 10 via its control means 32 are detailed for transferring a quantity of fluid.

As illustrated, the first function performed during the "fill routine" is to perform a check to see if the chamber is to be filled a multiple number of times from a single source container adjacent the bias overcoming means 106 of the first occlusion means 28. This check is illustrated by decision diamond 481 in FIG. 10*a*. If the bias overcoming means is not adjacent the appropriate occlusion arm 94, for the appropriate source container, the pumping microprocessor sends a signal to motor 105 to advance carriage 104 to position the bias overcoming means 106 adjacent the appropriate occluding arm 90 of the appropriate source container 12. This function is illustrated by block 482.

The next function performed by the fill routine is to obtain a tare weight from the load cell for the chamber. This function is illustrated by block 484 in FIG. 10*a*.

The next function performed by the fill chamber routine is to allow the chamber to stabilize to atmospheric pressure. This function is illustrated by block 485. The chamber can be quickly brought to atmospheric pressure in the preferred embodiment of the subject invention by allowing a solenoid valve 152 (not illustrated) to open to admit the pressure conduit, line 128, to suddenly go to atmospheric pressure. This in turn causes the pressure in the chamber to reach atmospheric pressure.

In a preferred embodiment of the invention, the next function performed by the fill chamber routine is to check to see if the weight to be pumped is less than 1.8 grams. This check is illustrated by decision diamond 486. If the weight to be pumped is less than 1.8 grams, the control means sends a signal to the peristaltic pump to cause the pump to rotate in a first direction to create a vacuum in the chamber. In the preferred embodiment of the invention, if the weight to be pumped is less than 1.8 grams, the control means causes the peristaltic pump to operate at one-third at its rated speed. This function is illustrated by block 488 in FIG. 10*a*.

If the weight to be transferred is not less than 1.8 grams, the control means sends a signal to the peristaltic pump to cause the pump to rotate in the first direction to create a vacuum in the chamber. However, in this instance, the signal causes the pump to operate at two-thirds of its rated speed. This function is illustrated by block 492 of FIG. 10*a*.

It should be noted that up to this point in the fill chamber routine, no fluid is actually being pumped into the chamber because the first occlusion means is biased so that all of the individual conduit lines are occluded. The next function performed by the fill chamber routine is to send a signal to solenoid 108 of the first occlusion means to cause rod 110 of the solenoid 108 to move into an extended position, thereby causing occluding arm 90 to move away from its associated individual tube 43 to allow fluid to flow from the appropriate source container into the chamber. The step of opening the appropriate supply valve is illustrated by block 496 in FIG. 10*a*.

FIG. 10*b* is a continuation of FIG. 10*a*. As illustrated, once the step identified by block 496 is performed, the routine continues to the blocks presented in FIG. 10*b* as indicated by connector A.

The next function performed by the fill routine is to allow the chamber to fill the desired weight as the peristaltic pump creates a vacuum in the chamber to draw fluid from a single source container into the chamber. As fluid is being drawn into the chamber, the load cell is constantly generating an analog signal which is sent to the A/D convertor to create a digital signal which is then transmitted to the pumping microprocessor. This function is illustrated by block 498 of FIG. 10*b*.

When the signal from the load cell indicates that the desired amount of fluid has been transferred to the chamber, the next function performed by the fill chamber routine is to turn off the peristaltic pump and de-energize solenoid 108 to prevent further fluid flow. This function is illustrated by block 500.

The next function performed by the fill routine is to once again allow the chamber to stabilize to atmospheric pressure. This function is illustrated by block 502, and is essentially identical to the function discussed above with respect to block 485. The pumping microprocessor then exits the fill routine and returns to the pumping routine, as described in U.S. Pat. No. 4,789,014.

In accordance with the invention, after each transfer of a fluid (or fluids if more than one fluid is to be added at a time), the mixing chamber is placed under positive pressure as illustrated. Subsequently, the pertinent occluder(s) is/are pulsed to allow fluid in the line to be forced upstream of the occluder(s) so as to clear the pertinent line(s). This ensures that other fluids are not inadvertently added to the mixing chamber during the subsequent vacuum assisted transfer of a fluid.

To that end, in a preferred embodiment of the invention as illustrated at block 501*a*, following transfer of a fluid, the control system causes the peristaltic pump to operate in the reverse direction to generate a positive pressure in the chamber 18. When the pressure is sufficiently high, preferably +2 PSIG, a pressure switch changes state to provide a signal to the control system that adequate pressure is present in the chamber 18. The indication of the pressure of sufficient positive pressure is processed via decision diamond 503*b*. Subsequently, the pertinent first occlusion means is opened for a sufficient duration to allow the remainder of the fluid just transferred to be pushed back past the first occlusion means, thereby clearing the drop former and supply line of fluid. In a preferred embodiment, the pertinent first occlusion means is/are pulsed open for a duration of 200 ms and again for 500 ms after assuring that the pressure is at +2 psi.

While a preferred embodiment has been shown, modifications and changes may become apparent to those skilled in the art which shall fall within the spirit and scope of the invention. It is intended that such modifications and changes be covered by the attached claims.

I claim:

1. A method for cleaning a conduit of fluid comprising the steps of:

providing a device for vacuum-assisted transfer of a fluid from a first container to a second container via a conduit coupling said containers together, said device including an occluder associated with said conduit and positioned between said containers to selectively allow transfer of a fluid, said occluder being closed following transfer of a fluid, said second container being placed under vacuum pressure during transfer of the fluid;

following transfer of a fluid, placing said second container under positive pressure; and sufficiently pulsing said occluder open to allow fluid downstream of said occluder to be forced upstream of said occluder.

2. The method of claim 1, wherein said occluder is pulsed open twice.

3. The method of claim 1, wherein said occluder is pulsed open for a duration of about 200 ms.

4. The method of claim 1, wherein said occluder is pulsed open a second time for a duration of 500 ms each.

5. The method of claim 1, wherein said second container is placed under a positive pressure of about +2 psig.

6. The method of claim 1, wherein said device includes a plurality of first containers all coupled to said second container.

7. A device for accurately transferring multiple individual fluids from multiple source containers to a single receiving container, in which fluid flows from said multiple source containers through individual fluid conduits to a chamber having a chamber fluid outlet conduit in fluid communication with the single receiving container, the chamber also having a pressure conduit, the invention comprising:

a first occlusion means for selectably preventing fluid flow from each of said individual fluid conduits to said chamber;

pressure means for selectively creating positive and negative pressures in said chamber to control the rate of fluid flow through said chamber;

second occlusion means for selectively occluding fluid flow from said chamber outlet fluid conduit to said receiving container; and control means for controlling said first and second occlusion means and said pressure means, said control means causing said first occlusion means to allow fluid to flow through at least one of said individual fluid conduits while causing said second occlusion means to prevent fluid flow into said receiving container and simultaneously causing said pressure means to create a negative pressure in said chamber to precisely control the amount of fluid flow into said chamber, said control means creating a positive pressure in said chamber and then causing said first occlusion means to allow fluid to flow in a fluid conduit associated with a most recently transferred fluid thereby allowing said positive pressure to force fluid in said conduit upstream of said first occlusion means, said control means further causing said first occlusion means to prevent fluid flow through all of said individual fluid conduits after a predetermined amount of fluid has been delivered to said chamber, said control means then further causing said second occlusion means to allow fluid to flow from said chamber through said outlet conduit while simultaneously causing said pressure means to create a positive pressure in said chamber to force fluid from said chamber into said receiving container.

8. The device of claim 7, wherein said first occlusion means further includes multiple individual occluder means for providing each individual fluid conduit a respective individual occluder means.

9. The device of claim 7, wherein following transfer of a fluid, said control means creates a positive pressure of about +2 psig.

10. The device of claim 7, wherein said control means, following transfer of a fluid, causes said first occlusion means to allow fluid to flow for a duration of about 700 ms while simultaneously creating said positive pressure in said chamber.

11. The device of claim 7, wherein said control means, following transfer of a fluid, allows fluid to flow in the conduit associated with the most recently transfer of fluid to flow in pulses of about 200 ms and 500 ms each while simultaneously creating said positive pressure in said chamber.

12. A device for transferring fluid from a first container to a second container comprising:

a conduit coupling said containers in fluid communication;

an occluder positioned between said containers and operatively associated with said conduit to selectively occlude said conduit thereby selectively permitting fluid to flow from said first container to said second container; and means for displacing fluid in said conduit upstream of said occluder including means for placing said second container under positive pressure.

13. The device of claim 12, wherein said means for displacing fluid in said conduit upstream of said occluder further includes means for causing said occluder to permit fluid to flow in said conduit while said second container is under positive pressure.

14. A device for transferring fluid from a first container to a second container comprising:

a conduit coupling said containers in fluid communication;

an occluder positioned between said containers and operatively associated with said conduit to selectively occlude said conduit thereby selectively permitting fluid to flow from said first container to said second container;

mean for displacing fluid in said conduit upstream of said occluder; and means for placing said second container under vacuum pressure during transfer of fluid from said first container to said second container.

15. A device for transferring fluid from a first container to a second container comprising:

a conduit coupling said containers in fluid communication;

an occluder positioned between said containers and operatively associated with said conduit to selectively occlude said conduit thereby selectively permitting fluid to flow from said first container to said second container; and means for displacing fluid in said conduit upstream of said occluder comprising means for placing said second container under a positive pressure and means for pulsing said occluder to thereby permit positive pressure to force fluid in said conduit upstream of said occluder.

16. The device of claim 15, wherein said occluder is pulsed open twice for durations of 200 ms and 500 ms each.

17. The device of claim 15, wherein said second container is placed under a positive pressure of about +2 psig.

18. A method of clearing a conduit of fluid comprising the steps of:

providing a device for transfer of a fluid from a first container to a second container via a conduit coupling said containers together, said device including an occluder associated with said conduit and positioned between said containers to selectively allow transfer of a fluid;

following transfer of a fluid, creating a differential pressure across the occluder whereby the greater positive pressure is exerted downstream of said occluder to thereby urge fluid in said conduit upstream of said occluder; and a sufficiently pulsing said occluder open to allow fluid downstream of said occluder to be forced upstream of said occluder.

19. The method of claim 18, wherein said occluder is pulsed open twice.

20. The method of claim 18, wherein said occluder is pulsed open for a duration of about 200 ms.

21. The method of claim 18, wherein said occluder is pulsed open twice for a duration of 200 ms and 500 ms each.

22. The method of claim 18, wherein said second container is placed under a positive pressure of about +2 psig.

23. The method of claim 18, wherein said device provides for vacuum-assisted transfer of a fluid from said first container to said second container.

* * * * *